US005343179A

United States Patent [19]

Pipich et al.

[11] Patent Number: 5,343,179

[45] Date of Patent: Aug. 30, 1994

[54] MINIATURIZED SOLENOID OPERATED TRIP DEVICE

[75] Inventors: Charles W. Pipich, Monroeville; David W. Fugate, Pittsburgh; James M. Marks, Trafford, all of Pa.

[73] Assignee: Eaton Corporation, Cleveland, Ohio

[21] Appl. No.: 11,065

[22] Filed: Jan. 29, 1993

[51] Int. Cl.[5] ..... H01H 9/20

[52] U.S. Cl. ..... 335/167; 335/172; 335/21

[58] Field of Search ..... 335/20-23, 335/167-176

[56] References Cited

U.S. PATENT DOCUMENTS

| | | | |
|---|---|---|---|
| 4,301,433 | 11/1981 | Castonguay et al. | 335/13 |
| 4,408,174 | 10/1983 | Seymour et al. | 335/20 |
| 5,105,326 | 4/1992 | Shimp et al. | 361/49 |

*Primary Examiner*—Lincoln Donovan
*Attorney, Agent, or Firm*—Martin J. Moran

[57] ABSTRACT

A solenoid operated circuit breaker trip device has a base defining a guide channel and an actuator that slides in the guide channel and interacts with a contact breaking mechanism having a trip bar operable to make or break electrical contacts. A spring biases the actuator toward the trip bar. A solenoid on the base electromagnetically displaces a plunger along a linear path and is coupled to a trigger having a latching surface that holds or releases the actuator. The guide channel runs parallel to the path of the plunger, adjacent the solenoid. The trigger is L-shaped and pivoted on a pivot pin between two legs of its L-shape, on an axis transverse to the path of the plunger. One of the two trigger legs is coupled to the plunger, and the other has an engagement surface that is moved behind a complementary surface of the actuator to selectively block its displacement. The base can be a slotted frame attached to the solenoid or a molded housing having an interior cavity for receiving the solenoid. A return spring urges the trigger toward the latching position.

14 Claims, 7 Drawing Sheets

66
62
84
28
42
26
52
34
32
68

MINIATURIZED SOLENOID OPERATED TRIP DEVICE

BACKGROUND OF THE INVENTION

1. Field of the Invention

The invention relates to a solenoid operated trip for releasing an electrical contactor, and in particular to an improved miniaturized contactor having a solenoid operated trip in lieu of a flux transfer shunt associated with a permanent magnet.

2. Prior Art

Circuit breakers and similar electrical contactors provide protection against faults in electrical power systems, such as overcurrent, ground fault and short circuit protection. In a typical contactor, a spring loaded plunger is arranged for movement between an extended trip position and a retracted normal position. In the extended position of the plunger, power connections to the load are opened. In the retracted position, the plunger is held by a permanent magnet, against the force of a spring urging the plunger to extend. A coil is associated with the permanent magnet. When a fault condition occurs, the coil produces a magnetic flux in opposition to the flux generated by the permanent magnet, thus releasing the force holding the plunger in the retracted position and allowing the spring to extend the plunger and open the power connections to the load. This arrangement is known as a flux shunt in that the coil shunts the permanent magnet. An example disclosed in U.S. Pat. No. 5,105,326—Shimp et al, also operates the flux shunt coil in the normal mode to assist the permanent magnet in holding the plunger in its retracted position (i.e., adding to the permanent magnet flux), thereby minimizing the incidence of nuisance trips.

Circuit breaker trip arrangements having a permanent magnet opposed by a spring rely on the balance of forces produced by the magnet and spring, respectively. The spring is set to a working compression or extension (e.g., compressed to a working height) that determines the force exerted. The extension or compression of the spring determines the force exerted, according to the spring constant of the spring. This force must be exceeded by the attractive force of the permanent magnet to hold the plunger in the normal retracted position. It is generally necessary to provide a means to adjust the spring arrangement initially to obtain the precise optimal spring force. Over time, the permanent magnet may become demagnetized, whereupon the spring is relatively more powerful than is optimal. Similarly, the spring may become relaxed such that the magnet is relatively more powerful. Application of releasing current to the flux shunt coil, which is an electromagnet, tends to demagnetize the permanent magnet due to the flux at a polarity opposite to that of the magnet. Whereas the balance of forces is sensitive to the extent of spring compression, and is affected by calibration and demagnetization of the magnet, nuisance trips may occur.

Additionally, permanent magnets have some inherent drawbacks. The coil-magnet arrangement is relatively large. The plunger-magnet assembly has a large mass, presenting a danger of tripping due to shock. The magnet also undesirably attracts magnetic debris. It would be advantageous to provide a function similar to a flux shunt arrangement that is not sensitive to calibration of the spring, is compact, and avoids the problems associated with permanent magnets.

Solenoid operated breaker mechanisms are known in some variations. U.S. Pat. No. 4,408,174—Seymour et al discloses a solenoid operable to release a plunger when the control voltage drops below the level necessary to withstand the force of a spring. U.S. Pat. No. 4,301,433—Castonguay et al discloses an example of a breaker mechanism having a holding solenoid that operates a toggle linkage when released.

The present invention employs a solenoid with a spring loaded actuator restrained by a latched lever forming a trigger for tripping the breaker, in a simple, compact and durable arrangement that is insensitive to spring constants, and has no permanent magnet.

SUMMARY OF THE INVENTION

It is an object of the invention to provide a structurally simple contactor trip arrangement that does not rely on shunting the flux of a permanent magnet.

It is also an object of the invention to provide a solenoid operated trip that is compact and durable.

It is a further object of the invention to eliminate problems with calibration of spring forces in a contactor tripping mechanism.

These and other objects are accomplished in a solenoid operated circuit breaker trip device that has a base defining a guide channel and an actuator bar that slides in the guide channel and interacts with a contact breaking mechanism having a trip bar operable to make or break electrical contacts. A spring biases the actuator bar toward the trip bar. A solenoid on the base electromagnetically displaces a plunger along a linear path and is coupled to a trigger having a latching surface that holds or releases the actuator bar. The guide channel runs parallel to the path of the plunger, adjacent the solenoid. The trigger is L-shaped and pivoted on a pivot pin between two legs of its L-shape, on an axis transverse to the path of the plunger. One of the two trigger legs is coupled to the plunger, and the other has an engagement surface that is moved behind a complementary surface of the actuator bar to selectively block its displacement. The base can be a slotted frame attached to the solenoid or a molded housing having an interior cavity for receiving the solenoid. A return spring urges the trigger toward the latching position.

BRIEF DESCRIPTION OF THE DRAWINGS

There are shown in the drawings certain embodiments of the invention as presently preferred. It should be appreciated that the invention is not limited to the specific arrangements shown in the drawings, and is capable of variation within the scope of the invention claimed. In the drawings.

DETAILED DESCRIPTION OF THE PREFERRED EMBODIMENTS

Figure 1:
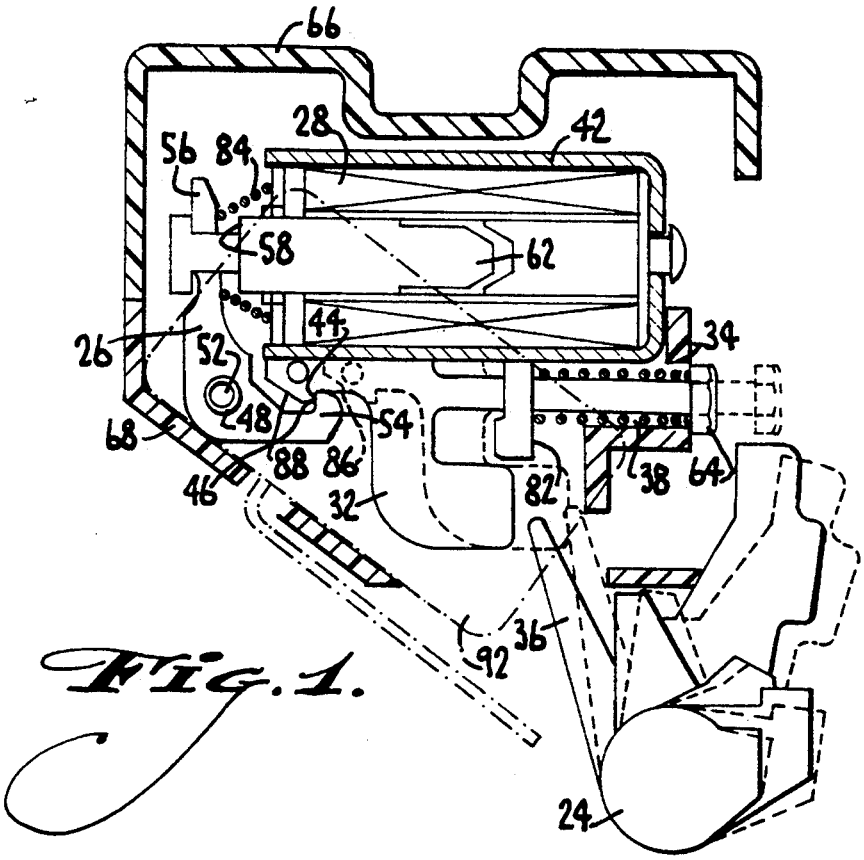
FIG. 1 is a section view through a miniaturized solenoid trip device according to the invention.
Figure 2:
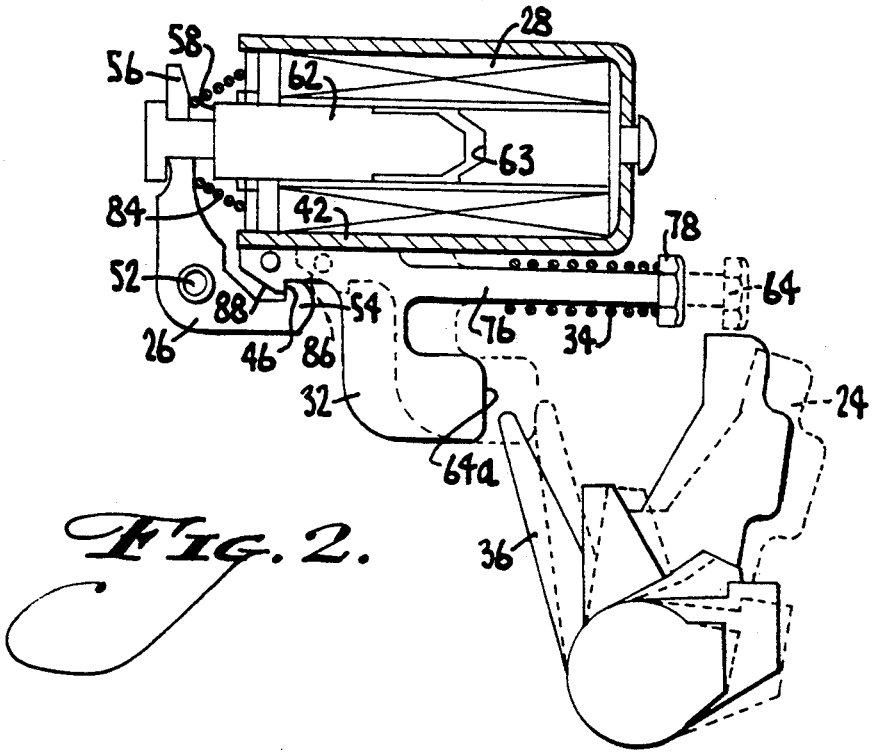
FIG. 2 is a schematic simplified section view of the device shown in FIG. 1, the casing and auxiliary switch shown removed.
Figure 3A:
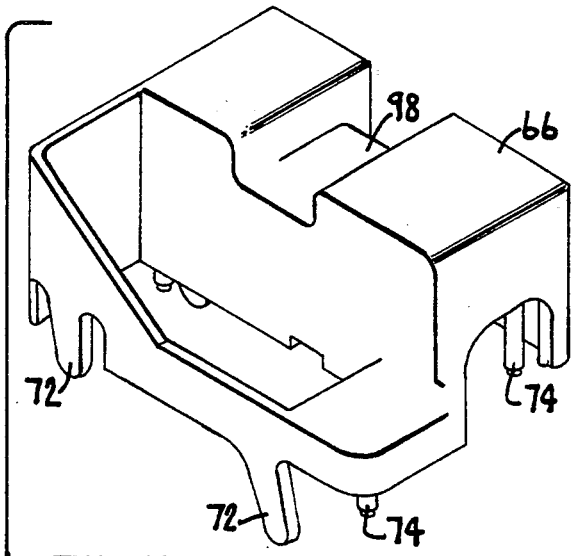
FIG. 3*a* is an exploded perspective view of the housing for the trip device according to FIG. 1.
Figure 4:
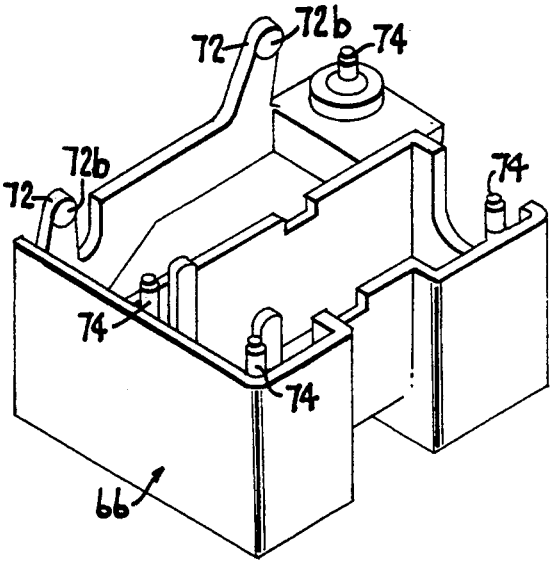
FIG. 4 is a perspective view showing the underside of the top cover in FIG. 3.

A preferred embodiment of the miniaturized solenoid operated trip device is shown in FIGS. 1–6. The device is arranged to snap into a two part molded housing 22 (shown in FIGS. 3*a*–3*d* and 4), and to strike a pivoting contact breaking mechanism 24 when triggered. The trip device has a generally L-shaped pivoting trigger member 26 operated by a solenoid 28 to restrain or release a sliding actuator 32 that is biased by at least one spring 34 to extend into the trip position, where the actuator strikes the trip bar 36 of a pivoting contact breaking mechanism. The contact breaking mechanism is operatively associated with a contactor cradle or the like (not shown) to make or break an electrical circuit.

Figure 6:
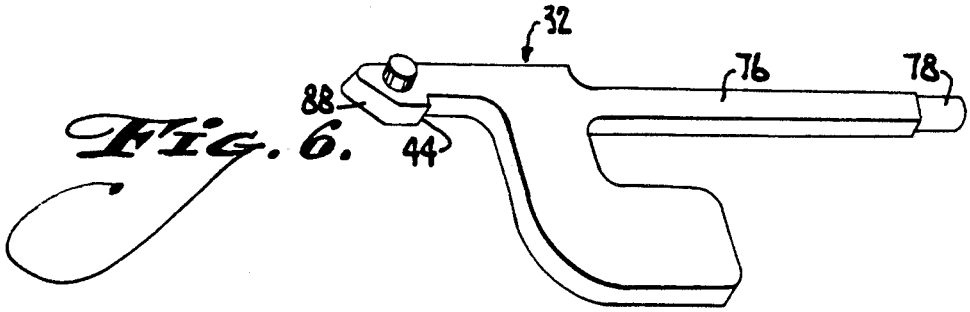
FIG. 6 is a perspective view illustrating the actuator member that interacts with the trip lever of FIG. 5.
Figure 3B:
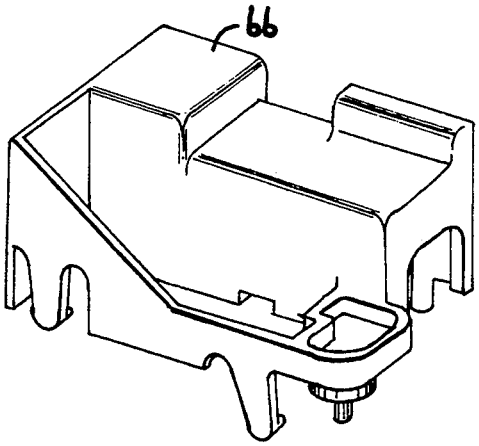
FIG. 3*b* is an exploded perspective assembly view showing the actuator, trigger and reset lever, with the solenoid to be dropped into place.
Figure 3C:
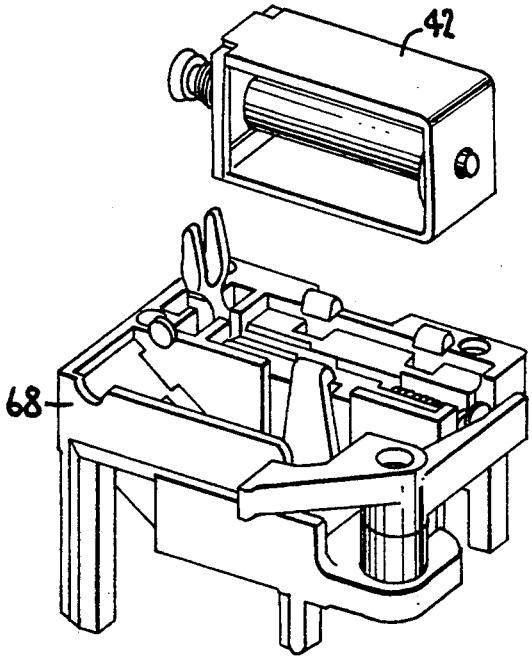
FIG. 3*c* is a perspective view showing the unit as assembled.
Figure 3C:
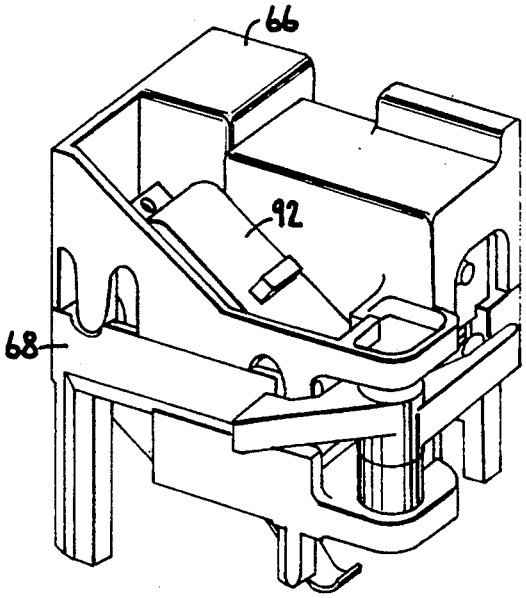
Figure 3D:
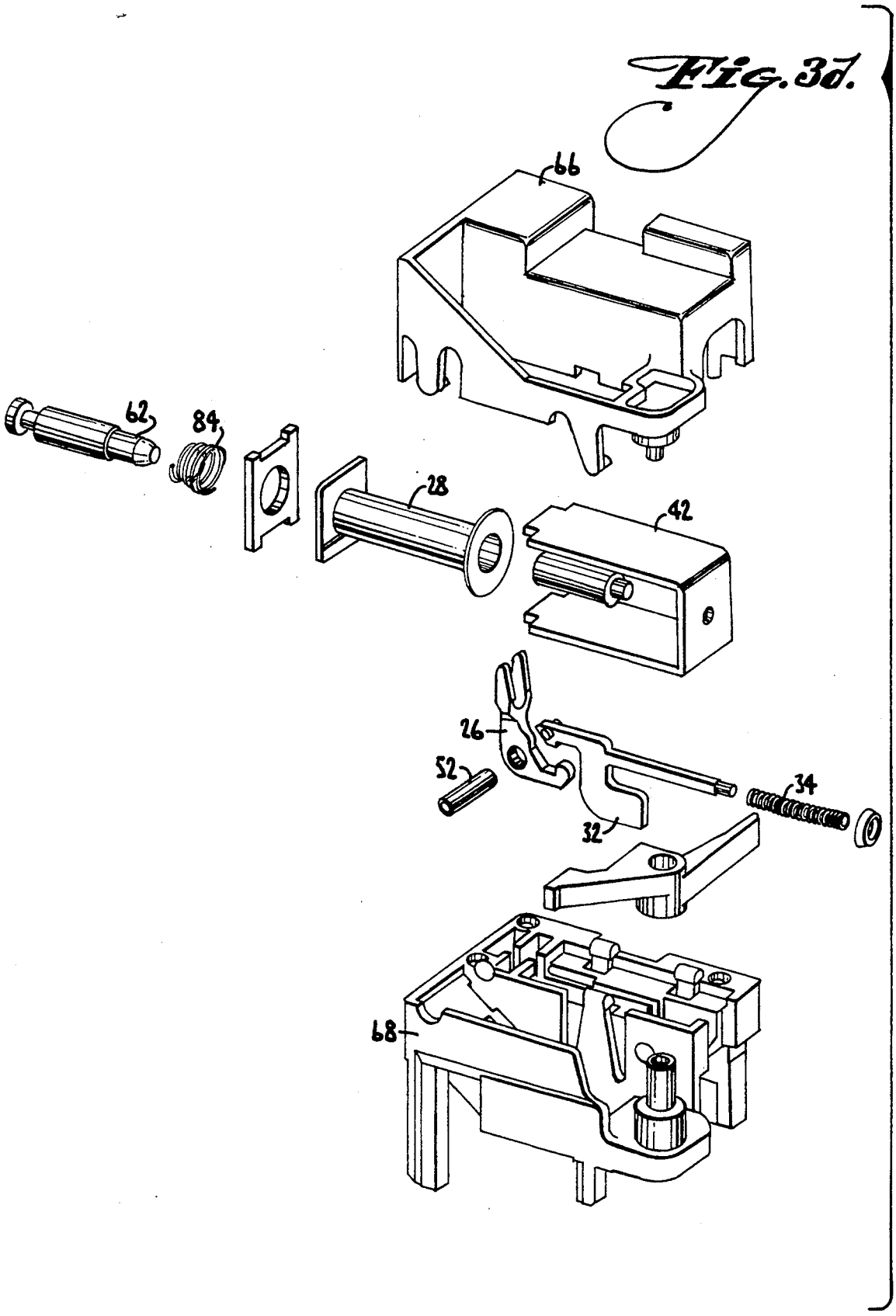
FIG. 3*d* is a perspective exploded view showing the mountings of the respective parts in more detail.
Figure 7:
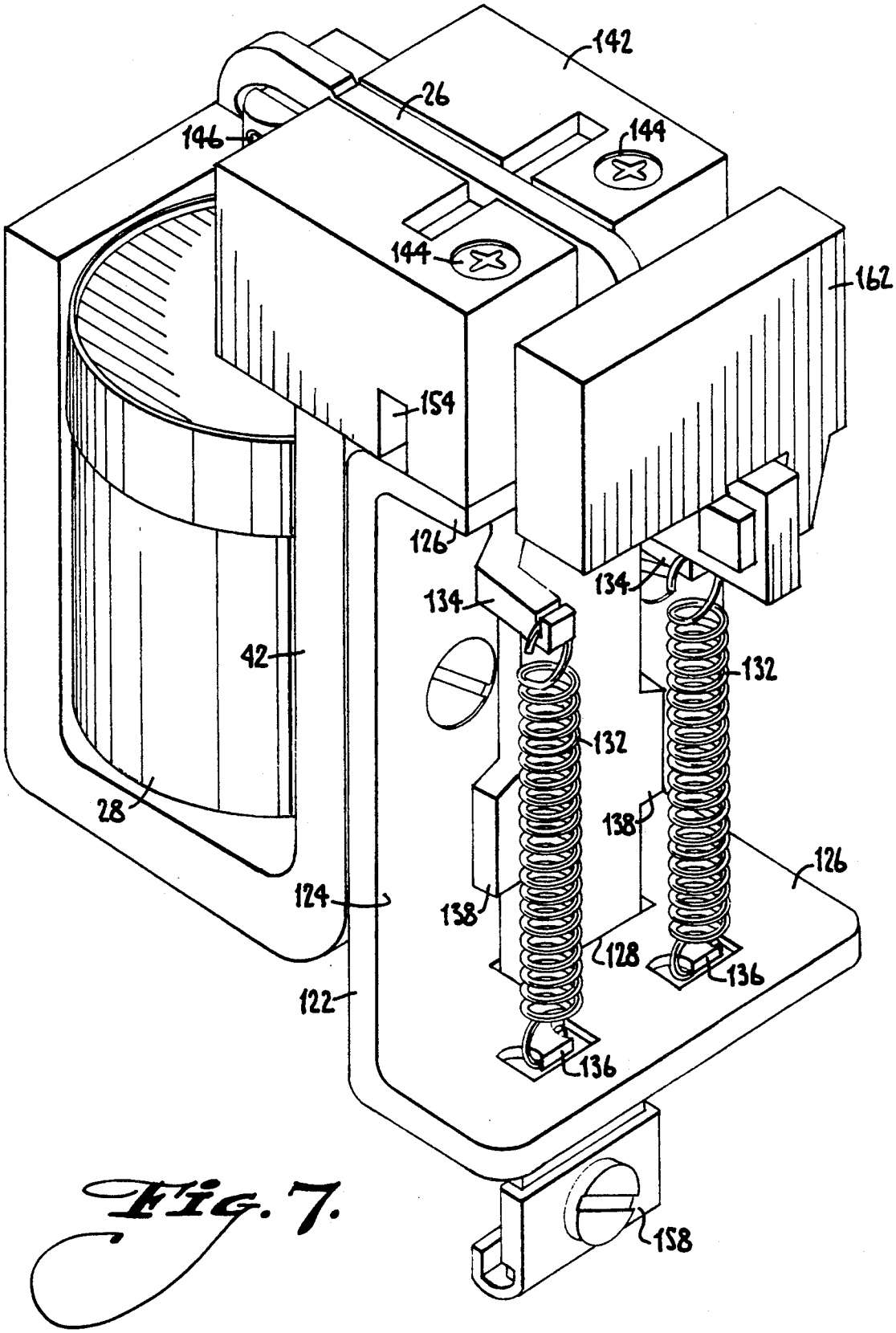
FIG. 7 is a perspective view illustrating an alternative embodiment of the invention.
Figure 8:
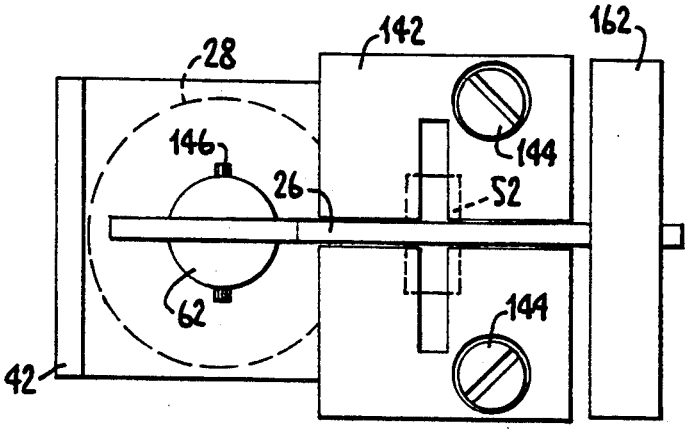
FIG. 8 is a top view of the device shown in FIG. 7.
Figure 9:
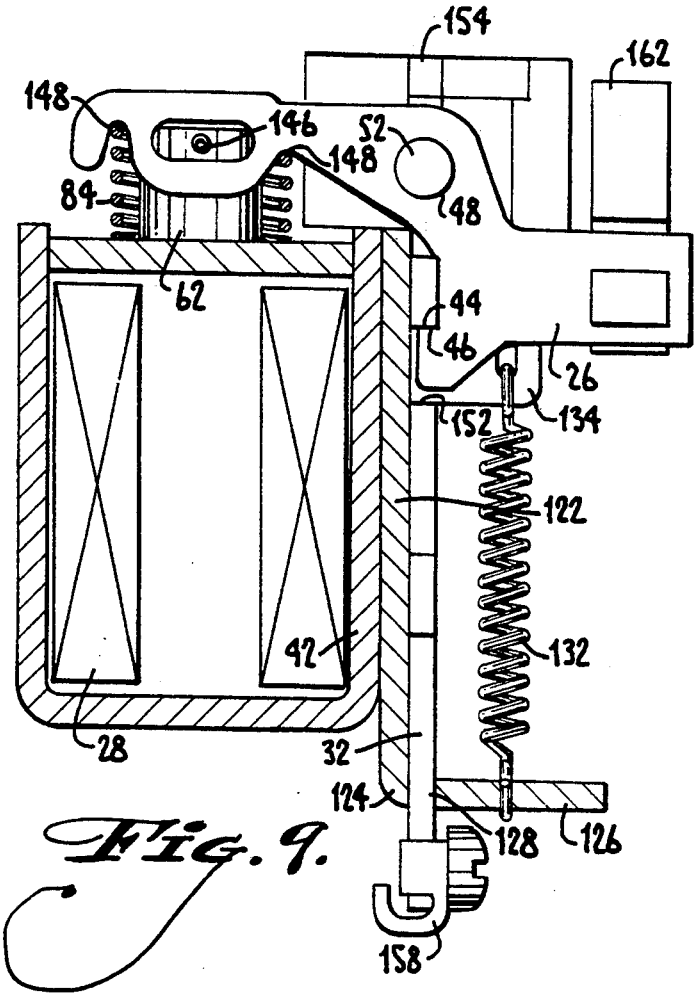
FIG. 9 is a section view taken along line 9—9 in FIG. 8.
Figure 10:
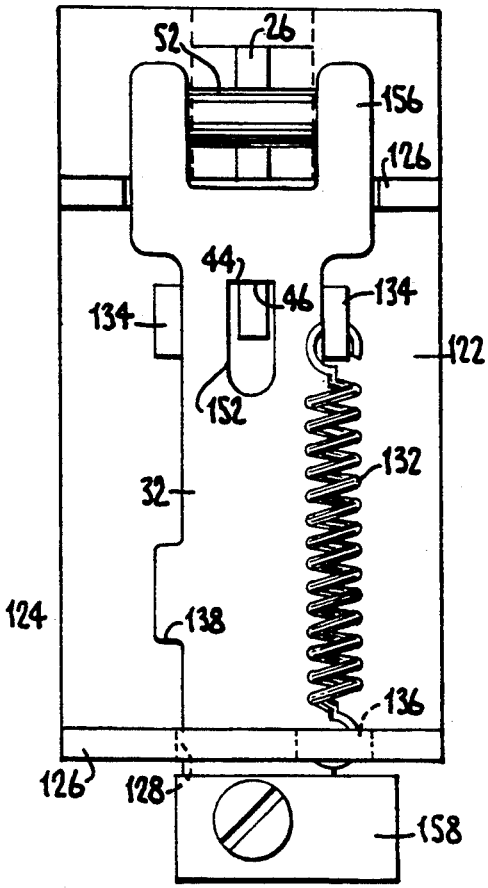
FIG. 10 is a section view taken along line 10—10 in FIG. 9.

The actuator member 32 is shown in its latched position in solid lines in FIG. 1, and in its extended position in broken lines. FIG. 6 illustrates the actuator member 32 separately. The actuator 32 is arranged to slide in a channel 38 adjacent the casing 42 of the solenoid 28, and is captured between the solenoid 28 and an internal wall of the bottom molded housing part 68. A trigger receiving latch surface 44 is defined on the actuator 32 at the end adjacent the plunger end of the solenoid casing 42. Spring 34 urges the actuator 32 to extend into a position where it strikes a protruding lever of the contact breaking mechanism 24. In the retracted and latched position, the actuator 32 is restrained against such extension by a complementary latch surface 46 of the trigger 26, urged toward the casing 42 of the solenoid, that clasps over the latch surface 44 of the actuator 32.

Figure 5:
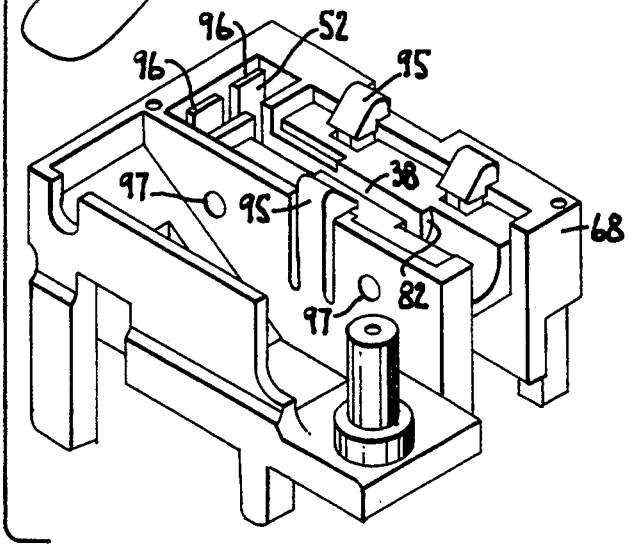
FIG. 5 is a perspective view illustrating the solenoid controlled trip lever of the device.
Figure 5:
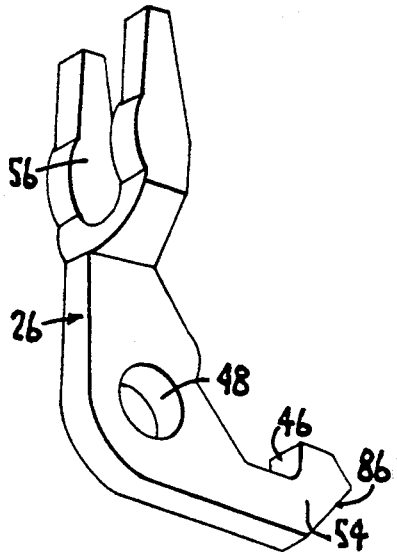

The trigger member 26 as shown in FIG. 5 is generally L-shaped and has a pivot hole 48 adjacent the junction of two legs of the L-shape, whereby the trigger member 26 is pivotally mounted on a pin 52 mounted in the bottom molded housing part 68. The trigger latch surface 46 is defined by a tooth 54 at one end of actuator 32, and a U-shaped collar 56 is defined at the other end. The U-shaped collar 56 is retained in a groove 58 on the solenoid plunger 62.

Current can be switched to the solenoid 28 in known manner, for example when an overcurrent condition, undervoltage or ground fault is detected in the load circuit. When current is applied, the solenoid plunger 62 retracts into the solenoid 28 (to the right in FIGS. 1 and 2), against the stationary seat 63 of the solenoid. The trigger lever 26 is thereby rotated (clockwise as shown) around its mounting pin 52, releasing its interlock with the mating hook surface 44 on the actuator 32. The actuator spring 34 propels the actuator 32 outwardly (to the right in the drawing) with a dynamic action such that an abutment 64*a* of the actuator strikes the paddle on the trip bar, activating the trip release mechanism of the circuit breaker. It is possible to arrange the actuator 32 to strike the trip release mechanism directly, or to operate an intermediate part that in turn operates the trip release mechanism to separate the electrical contacts carrying current to a load.

The actuator 32 and trigger 26 can be die cast zinc alloy parts. They could also be investment cast, machined, or perhaps stamped. The actuator 32 and trigger 26 are mounted in a channel 38 of the bottom molded housing part 68, which can be plastic. The housing 22 has a top part 66 and a bottom part 68 that clip together in a snap fit via interference pin means comprising alignment pins 74. The bottom part 68 (FIG. 3*a*) and the top part 66 (FIG. 4) of the housing 22 together define an internal cavity for holding the solenoid 28, actuator 32 and trigger 26. Pivot pin 52 is retaining in bottom housing part 68 via retaining clasps 96. The trigger 26 is held in place by a steel pivot pin 52, and the actuator 32 is constrained to move only back and forth by the slotted structure of the bottom housing part 68. With final closure of the housing 22, the channel for the actuator is also defined by the side of the solenoid casing 42, which snaps in place via retaining clasps 95 (FIGS. 3*a*–3*d*). Snap arms 72 are used to hold an auxiliary switch 92 in place, thus obviating the need for screws.

The actuator 32 has an elongated stem 76 on which the compression spring 34 for extending the actuator 32 is received. The spring 34 is held on the stem 76 by an enlargement 78 at the end of the stem, such as a spring retainer that is swaged in place on a cylindrical protrusion of the actuator 32, through a hole in the spring retainer. In this embodiment the molded housing 22 forms the base of the trip device. The spring 34 moves the actuator 32 by pressing outwardly on the spring retainer, with the other end of the compression spring 34 bearing against a reaction surface 82 on the inside of the bottom housing part 68.

A second compression spring 84 is arranged to bias the solenoid plunger 62 away from the solenoid body, for reset purposes. The second compression spring 84 applies force between the body of the solenoid and the U-shaped clasp 56 of the trigger 26, thus keeping the hook end of the trigger 26 pressed against the actuator tip when the solenoid 28 is not energized to retract the plunger 62. The second compression spring 84 is preferably weaker than the actuator spring 34.

The second compression spring 84 thus urges the latch structure of the trigger 26 toward the casing 42 of the solenoid 28, and normally against the actuator 32. The trigger member 26 and the actuator 32 have complementary inclined surfaces 86, 88 leading to their latching surfaces 46, 44. When the actuator 32 is pushed back in by the handle of the breaker via an intermediate reset lever (not shown) acting at end 64, after having been extended, the trigger 26 automatically lifts via the facing inclines 86, 88 and snaps back to re-engage the actuator 32. Thus the solenoid operated trip device as shown is reset simultaneously with the resetting of the other mechanisms of the breaker, including for example the cradle that ultimately opens and closes the contacts leading to the load.

An accessory auxiliary switch 92 is preferably provided, as shown in broken lines in FIG. 1, arranged to be operated when the mechanism trips (i.e., opens). The auxiliary switch 92 can be a miniature limit switch, arranged in the housing 22 in tandem with the solenoid operated trip device. Whereas the solenoid operated trip device is substantially smaller than a flux transfer shunt trip arrangement, it is possible to relocate the auxiliary switch for a more compact arrangement. A conventional shunt trip occupies one attachment area (one pole space), whereas the solenoid operated trip device of the invention occupies only one half of an attachment area.

The auxiliary switch is retained in place via leaf spring retaining clasps 72 (which have inward facing protruding pins **72*b* at their ends, and protrusions 97, molded into the bottom housing part 68. These protrusions mate with mounting holes (not shown) in the housing of the auxiliary switch. Wires coupled to the auxiliary switch can be led out of the circuit breaker housing through wire trough 98**.

Figure 11:
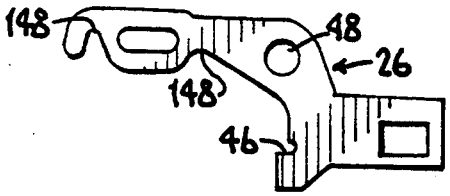
FIG. 11 is a side elevation view of the trip lever of the embodiment of FIG. 7.
Figure 12:
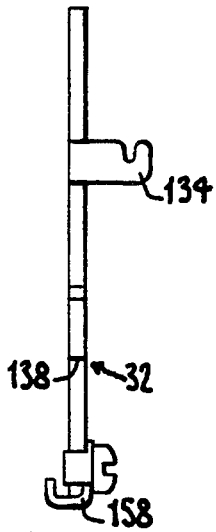
FIG. 12 is a side elevation of the actuator member according to FIG. 7, for interacting with the trip lever.
Figure 13:
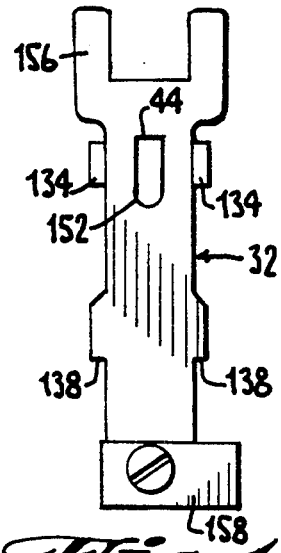
FIG. 13 is a front elevation view of the actuator according to FIG. 12.

FIGS. 7–10 show a second embodiment of the solenoid operated trip device of the invention, which is also miniaturized and arranged to fit in a contactor housing in place of a flux transfer shunt type trip. The same reference numbers are used throughout the drawings to identify the comparable elements of the respective embodiments. The trigger 26 for this embodiment is shown in FIG. 11, and the actuator 32 is shown in FIGS. 12 and 13. The device comprises a frame 122 that forms the base of the device. The frame is basically U-shaped, having a back Two extension springs 132 are stretched between ears 134 formed on the actuator bar 32 and spring-receiving cutouts 136 on the lower flange of the frame 122, thereby urging the actuator 32 to extend into a position where it strikes the contact breaking mechanism (not shown in FIGS. 7–10). The actuator bar 32 has two laterally protruding shoulders 138 that abut against the lower flange 126 of the frame 122 when the actuator bar 32 is extended. Accordingly, there is still some tension on the extension springs 132 when the actuator 32 is extended, which tension keeps the ends of the springs 132 from coming free of the actuator ears 134 and the lower flange 126 of the frame 122. It is also possible to use means other than lateral shoulders 138 to stop the actuator 32 at a maximum extended position, such as one or more stamped buttons on the actuator 32 for abutting against the lower flange 126.

A pivot block 142 is attached by screws 144 to the top flange 126 of the frame 122, and carries a transverse pivot pin 52 for pivotally retaining the trigger member 26. As in the foregoing embodiment, the trigger member 26 is L-shaped, and attached to the plunger 62 of the solenoid 28. The trigger 26 is shown separately in FIG. 11. In this embodiment, the trigger and actuator can be steel stampings, or they can be zinc die cast parts as in the foregoing embodiment. In this embodiment, however, the plunger 62 is affixed to the trigger 26 by a transverse roll pin 146. A return compression spring 84 is mounted between the trigger 26 and the body of the solenoid 28, urging the plunger 62 outwardly and urging the trigger 26 into the latching position for reset purposes. The end of the trigger 26 at the plunger 62 is arranged with channels 148 for keeping the return compression spring 84 in proper position.

The trigger member 26 has a latching portion that is urged by the return spring 84 into a complementary opening 152 in the actuator 32, such that abutting latch surfaces 46, 44 of the trigger 26 and actuator 32 hold the actuator 32 in the retracted, ready-to-trip position. When the trigger 26 is pivoted by retraction of the solenoid plunger 62, the latching portion of the trigger 26 is drawn outwardly to clear the opening 152 in the actuator 32, allowing the actuator 32 to extend by force of the extension springs 132.

As in the foregoing embodiment, the device resets automatically when the breaker handle mechanism (not shown in FIGS. 7–10) pushes the actuator 32 back into the retracted position. This occurs because when the actuator 32 is extended (and assuming the solenoid is not powered), the latching end of the trigger 26 is urged by the return spring 84 against the surface of the actuator 32. The latching end of the trigger 26 simply slides on the surface of the actuator 32 until retraction of the actuator 32 brings the latching hole 152 into alignment with the latching end of the trigger 26, whereupon the trigger 26 and actuator 32 are again engaged and ready to trigger.

The top of the actuator 32 extends into a clearance slot 154 in the pivot block 142 attached to the upper flange 126 of the frame 122. The top of the actuator 32 defines a fork 156 having a central opening, so as to move in the clearance slot 154 while remaining clear the trigger 26. Preferably, the actuator 32 is guided for translational movement by the openings 128 in the top and bottom flanges 126 of the frame 122 rather than by the slot 154 in the pivot block 142, which better ensures proper alignment of the actuator 32 and no chance of jamming.

The actuator 32 has a forked upper end 156 because the pivot axis of the trigger 26 must be in the same plane as the latch interface and the movement of the actuator 32, thus arranging the latching surfaces of the trigger 26 and the actuator 32 parallel to one another and relatively movable in a tangent to a circle around the trigger pivot axis defined by trigger pivot pin 52.

In the embodiment shown, the end of the actuator 32 that strikes the breaker mechanism is provided with a pad 158 attached by a screw. Alternatively, the end can be rounded or bent over to form a similar shape without the requirement of assembling parts.

An anti-shock mass 162 is mounted on the trigger 26 opposite the trigger pivot axis from the plunger 62 of the solenoid 28. The mass 162 is sized and arranged at a distance from the pivot axis to balance the mass of the solenoid plunger 62. In the embodiment shown, the antishock mass 162 has a mass approximately equal to the plunger mass, and is attached to the trigger 26 via a protruding tab that extends laterally through the trigger 26 at a distance from the pivot axis approximately equal to the distance between the plunger 62 and the pivot axis. It will be appreciated that a smaller mass at a greater distance from the pivot or a larger mass that is closer, would likewise serve to balance the mass of the plunger. Should a shock be applied to the device wholly or partly perpendicular to the pivoting axis of the trigger 26, the shock acts equally on the plunger 62 and on the anti-shock mass 162, cancelling the effect of the shock and preventing unwanted operation of the breaker by preventing movement of the trigger 26 as a result of the shock.

Figure 14:
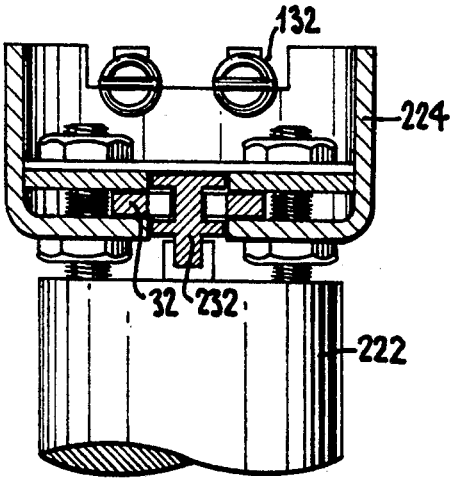
FIG. 14 is a section view through a further alternative embodiment, comprising a rotary solenoid.
Figure 15:
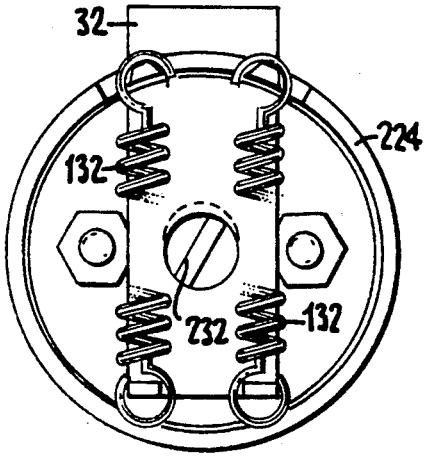
FIG. 15 is an elevation view of the rotary solenoid embodiment of FIG. 14.
Figure 16:
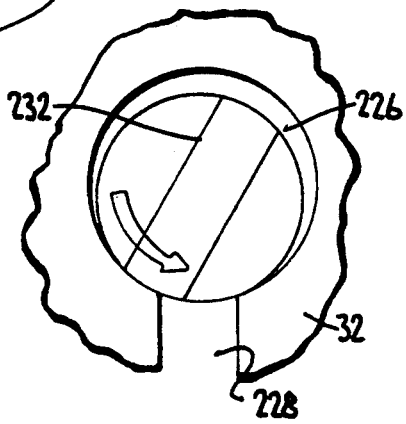
FIG. 16 is a partial elevation view of the embodiment of FIG. 14, showing the interaction of the trigger member and the actuator.

Another alternative embodiment is shown in FIGS. 14–16. In this embodiment the trigger motion is rotary, which inherently is resistant to unwanted operation due to shock. The rotary arrangement as shown in FIGS. 14 and 15 comprises a rotary solenoid 222 attached to the underside of a metal cup 224 forming the base of the trip device. An actuator 32 slides across a diameter of the cup 224, and is loaded by extension springs 132 in a manner similar to the embodiment of FIGS. 7–10. One end of each of the springs 132 is fastened to the actuator 32 and the other end is fastened to the side of the metal cup 224.

The actuator 32 has an opening 226 and a slot 228 for receiving a rotary trigger element 232. The opening freely encompasses the trigger element 232, and the slot 228 is coupled to the opening 226 and extends parallel to the direction of sliding displacement of the actuator 32. As shown in FIG. 16, in the plane of the actuator 32 the rotary trigger element 232 is narrow, having a wider dimension than the slot 228 along one axis and a narrow dimension along an axis perpendicular thereto. The trigger 232 is rotatable by operation of the rotary solenoid 222 to align the trigger element 232 for passage in the slot 228, thus freeing the actuator 32 to slide as the trigger element 232 passes along the slot 228 of the actuator 32. Otherwise, the wider dimension of the trigger element 232 blocks passage in the slot 232 and the actuator 32 is retained because the trigger element 232 is captured in the opening 226. The actuator 32 is forced out of the cup 224 (in an upward direction as shown in FIG. 15) by the springs 132 when the rotary solenoid 222 is operated. When the elongation of the trigger element 232 is aligned with the slot 228 coupled to the opening 226 of the actuator 32, the latch is released and the springs 132 force the actuator 32 outward.

By including a return spring (not shown) coupled circumferentially between the cup 224 and the solenoid 222, this arrangement is also self-resetting. Whereas the trigger element 232 is carried in the slot 228, the trigger element 232 remains aligned to the slot 228 until the actuator 32 is pushed back to its home position. Upon reaching the opening 226 (and assuming the solenoid is not powered), the trigger element 232 rotates back to its blocking position and the actuator 32 is locked and loaded.

The rotary arrangement of FIGS. 14–16 is advantageous in that it needs no counteracting mass for resistance to displacement due to shock. This is inherent in the rotary design because shocks applied to the breaker are likely to be translational rather than rotary.

The invention performs a function similar to that of a flux transfer shunt trip, but is wholly solenoid driven. Whereas no permanent magnet is needed, the arrangement is small. The arrangement is insensitive to calibration requirements such as setting the working height of a spring opposed to a plunger retained by a permanent magnet, and operates reliably over a range of spring pressures at least exceeding a minimum value. The solenoid force does not vary over time as with demagnetization of a permanent magnet, and the solenoid does not collect magnetic debris. The compact arrangement as shown is efficient, and opens room in the breaker housing for additional accessories, such as auxiliary switch 92.

The invention is insensitive to shock for a number of reasons. The mass of the solenoid plunger 62 is small, with resulting reduction of inertial forces, as compared to the assembly of a plunger and permanent magnet. The counteracting mass 162 also opposes and resists displacement with shock applied in the direction of plunger motion, and the arrangement is balanced in all three directions.

The invention having been disclosed in connection with certain preferred exemplary embodiments, variations which embody the inventive concepts will now become apparent to persons skilled in the art. The invention is not limited to the exemplary embodiments shown and is intended to encompass such variations. Accordingly, reference should be made to the appended claims rather than the foregoing examples, in order to assess the scope of the invention in which exclusive rights are claimed.

We claim:

1. A trip apparatus for an electrical contactor having circuit breaker means operable to couple and decouple electrical contacts, the trip apparatus comprising:

a base;

an actuator arranged on the base, the actuator being extendable to contact said circuit breaker means and retractable from said circuit breaker means, for breaking and making the electrical contacts, respectively;

at least one spring coupled between the actuator and the base, the spring being operable to bias the actuator toward the circuit breaker means;

a solenoid having an element that is electromagnetically displaceable upon application of power to the solenoid, and means for returning said element to a home position upon cessation of the power;

a trigger coupled to the actuator and to the displaceable element of the solenoid, the trigger being arranged to release the actuator for movement toward the circuit breaker means upon application of power to the solenoid; and wherein the trigger and the actuator each comprise complementary latch surfaces, the trigger being rotatably mounted on an axis for movement by the solenoid between two positions, and wherein in one of the two positions the trigger engages the actuator to block movement of the actuator by engagement of the complementary latch surfaces, and in another of the two positions the trigger disengages the complementary latch surfaces to release the actuator.

2. The trip apparatus according to claim 1, wherein the means for returning said element to the home position comprises a return spring, and wherein the trigger is movable by the return spring to re-engage the actuator when moved away from the circuit breaker means.

3. The trip apparatus according to claim 2, wherein the circuit breaker means comprises a reset mechanism and wherein the reset mechanism is operable to move the actuator away from the circuit breaker means, whereby the trip apparatus is reset by operation of the reset mechanism.

4. The trip apparatus according to claim 1, wherein the trigger is pivotally mounted via a pivot pin fixed relative to the base, the trigger being attached on one side of the pivot pin to a plunger of the solenoid, and wherein the complementary latch surface of the trigger comprises a latch tooth on the trigger on an opposite side of the pivot pin, movably arranged to latch over a portion of the actuator on a side of said portion facing the circuit breaker means.

5. The trip apparatus according to claim 1, wherein the trigger comprises an elongated narrow key part and the actuator has an opening dimensioned to encompass the key part, the opening leading into a slot aligned in a direction toward the circuit breaker means, the slot being narrower than the opening, to encompass the key part at one rotary orientation of the trigger and to block passage of the key part at another orientation of the key part, the solenoid being coupled to move the key part between said one orientation and said another orientation.

6. The trip apparatus according to claim 4, wherein the trigger and the actuator comprise facing inclines leading to the complementary surfaces, and wherein upon retracting the actuator from the circuit breaker means, said facing inclines deflect the complementary surface of the trigger relative to that of the actuator, against a bias of the return spring, and upon passing, the complementary surfaces lock together.

7. The trip apparatus according to claim 4, wherein the complementary surface of one of the actuator and the trigger comprises a protrusion for insertion into a gap defined in the other of the actuator and the trigger, the return spring urging the protrusion in a direction of insertion, and said other of the actuator and the trigger having an unobstructed surface leading to the gap, whereby the protrusion is carried along the surface to fall into the gap for latching the actuator when retracted.

8. The trip apparatus according to claim 1, wherein the solenoid comprises a plunger arranged for linear displacement, the trigger being pivotally mounted on a pivot axis transverse to said linear displacement, the trigger being attached on one side of the pivot axis to the plunger, and further comprising an anti-shock mass coupled to the trigger on an opposite side of the pivot axis from the plunger, whereby said anti-shock mass limits displacement of the trigger due to shock directed parallel to the linear displacement.

9. The trip apparatus according to claim 8, wherein the anti-shock mass is sized and spaced from the pivot axis to balance a mass of the plunger.

10. A solenoid operated circuit breaker trip device, comprising:

a base defining a guide channel;

an actuator bar disposed in the guide channel for sliding movement;

a contact breaking mechanism having a trip bar, operable to make or break electrical contacts, the contact breaking mechanism being disposed along the sliding movement of the actuator bar;

a spring operable to bias the actuator bar toward the trip bar;

a solenoid mounted relative to the base and operable electromagnetically to displace a plunger along a linear path;

a trigger coupled to the plunger and having a latching surface, the trigger being mounted for movement by the plunger selectively to displace the latching surface between a latching position at which the latching surface is disposed to block the sliding movement of the actuator bar toward the trip bar, and a release position at which the latching surface is clear of the actuator bar along the sliding movement of the actuator bar; and, wherein the guide channel is arranged parallel to the linear path of the plunger and adjacent the solenoid, further comprising a pivot pin carrying the trigger, the trigger having substantially an L-shape and being pivoted on the pivot pin between two legs of the L-shape, the pivot pin being oriented transverse to the linear path of the plunger, wherein one of the two legs is coupled to the plunger, and wherein the trigger comprises an engagement surface disposed on the other of the two legs, operable to block the sliding movement of the actuator bar.

11. The solenoid operated circuit breaker trip device according to claim 10, wherein the base comprises a housing having an interior cavity for receiving the solenoid, the guide channel being partly bounded by the solenoid.

12. The solenoid operated circuit breaker trip device according to claim 10, wherein the base comprises a frame having at least one guide opening for the actuator bar, the frame being affixed to the solenoid.

13. The solenoid operated circuit breaker trip device according to claim 10, further comprising a return spring operable to urge the trigger toward the latching position.

14. The solenoid operated circuit breaker trip device according to claim 10, wherein the base comprises a two part molded housing including interference pin means operable to close the housing around the solenoid, trigger and actuator bar.

* * * * *